US006162085A

United States Patent [19]

Chugh et al.

[11] Patent Number: 6,162,085

[45] Date of Patent: Dec. 19, 2000

[54] ELECTRICAL CONNECTOR ASSEMBLY FOR JUMPER CABLE

[75] Inventors: Marcus B. Chugh, Royal Oak; Matthew K Monden, Harrison Twp., both of Mich.

[73] Assignee: Delphi Technologies, Inc., Troy, Mich.

[21] Appl. No.: 09/377,123

[22] Filed: Aug. 19, 1999

[51] Int. Cl.[7] ..... H01R 13/58

[52] U.S. Cl. ..... 439/467; 439/460; 439/752; 439/275

[58] Field of Search ..... 439/467, 466, 439/460, 465, 469, 275, 752

[56] References Cited

U.S. PATENT DOCUMENTS

| | | | |
|---|---|---|---|
| 3,856,376 | 12/1974 | Poliak et al. | 439/467 |
| 3,887,256 | 6/1975 | Klimek et al. . | |
| 4,010,999 | 3/1977 | Hoffman | 439/467 |
| 4,037,907 | 7/1977 | Klimek et al. . | |
| 4,106,834 | 8/1978 | Horowitz . | |
| 4,786,261 | 11/1988 | Ramos, Jr. . | |
| 4,886,466 | 12/1989 | Doherty et al. . | |
| 4,969,839 | 11/1990 | Nilsson . | |
| 5,080,594 | 1/1992 | Swinford . | |
| 5,224,874 | 7/1993 | Sell . | |
| 5,302,141 | 4/1994 | O'Reilly et al. . | |
| 5,514,006 | 5/1996 | Getselis et al. | 439/467 |
| 5,575,692 | 11/1996 | Cecil, Jr. et al. . | |
| 5,588,870 | 12/1996 | Boteler et al. | 439/467 |
| 5,720,623 | 2/1998 | Polenick et al. . | |
| 5,873,744 | 2/1999 | Ramos, Jr. . | |
| 5,885,099 | 3/1999 | Sandor | 439/467 |

*Primary Examiner*—Paula Bradley
*Assistant Examiner*—Katrina Davis
*Attorney, Agent, or Firm*—Richard A. Jones

[57] ABSTRACT

An electrical connector assembly for a tractor-trailer jumper cable has an outer connector housing with an internal block of terminal cavities that is recessed to provide cylindrical sockets in each end of the outer connector housing. Each cavity receives a lead terminal and a lead seal attached to an end of one of the insulated leads of the jumper cable. A terminal position assurance (TPA) device having an integral clam shell strain relief is plugged into the socket at the cable end of the outer connector housing to make sure that the lead terminals and lead seals are properly positioned and to provide a strain relief for the cable. A disposable transition connector is plugged into the socket at the contact end of the outer connector body to seal the contact end and protect the cable terminals against corrosion.

6 Claims, 3 Drawing Sheets

ELECTRICAL CONNECTOR ASSEMBLY FOR JUMPER CABLE

FIELD OF THE INVENTION

This invention relates to electrical connector assemblies and more particularly to an electrical connector assembly for use as a tractor-trailer jumper cable.

BACKGROUND OF THE INVENTION

The seven conductor electrical connector is used exclusively in the United States and Canada as the electrical interface between highway tractors and trailers. The exclusive use of this connector makes it possible to pull any trailer with any tractor without use of adapters.

The tractor-trailer electrical connector system comprises a jumper cable with an identical electrical plug connector at each end, a receptacle attached to the tractor and another receptacle attached to the trailer. This invention relates to an electrical connector assembly that is particularly usefull for the electrical plug connector at one or both ends of the jumper cable.

U.S. Pat. No. 3,887,256 granted to Boleslaw Klimek et al Jun. 3, 1975 and U.S. Pat. No. 4,106,834 granted to Charles Horowitz Aug. 15, 1978 both disclose an electrical connector assembly for a tractor-trailer jumper cable comprising a metallic housing having a cable clamp at one end and a body member containing terminals at the other end. Each lead of the cable is attached to one of the terminals.

U.S. Pat. No. 4,786,261 granted to Phillip M. Ramos, Jr. Nov. 22, 1988 discloses an electrical connector assembly for a tractor trailer jumper cable comprising an outer plastic housing having a cable clamp at one end and an inner body member and cap at the other end. The inner body member holds terminals which are crimped onto the ends of the respective cable leads.

U.S. Pat. No. 4,969,839 granted to Carl R. Nilsson Nov. 13, 1990 discloses an electrical connector assembly for a tractor trailer jumper cable comprising an outer metallic housing having a screw cap at the cable end. A terminal holder with insulation piercing terminals is disposed in the contact end. A cable holder separates, bends and reverses the leads of the jumper cable. The cable holder with the reversed leads attached is inserted into the cable end of the housing and pushed against protruding insulation piercing portions of the terminals by the screw cap.

U.S. Pat. No. 5,224,874 granted to Edward D. Sell Jul. 6, 1993 discloses an electrical connector assembly for a tractor trailer jumper cable in which terminals are attached to individual leads of the jumper cable. The terminals are then insert molded in an elastomeric body that covers the individual leads and an end portion of the cable as well as the terminals. The contact end of the connector includes a metal sleeve around the elastomeric body.

SUMMARY OF THE INVENTION

This invention provides an improved electrical connector assembly that is particularly usefull for a tractor-trailer jumper cable and has one or more of the following features.

A feature of the invention is the electrical connector assembly has cable terminals in an inner connector body integrally attached inside an outer connector housing that has sockets at each end to improve the sealing environment for the cable terminals in the connector housing.

Another feature of the invention is that the electrical connector assembly has individual cable seals for sealing each insulated electrical lead at the cable end of the electrical connector assembly.

Still another feature of the invention is that the electrical connector assembly has a terminal position assurance (TPA) device that is plugged into a socket at the cable end of an outer connector housing and that has an integral strain relief in the form of closeable clam shells that encloses the individual leads and clamps the insulation jacket of the multilead cable exiting the connector housing.

Still yet another feature of the invention is that the electrical connector assembly has a disposable, insert molded transition connector that plugs into the socket at the connector end of the outer connector housing and seals the connector end of the connector housing.

These and other objects, features and advantages of the invention will become more apparent from the following description of a preferred embodiment taken in conjunction with the accompanying drawing.

DETAILED DESCRIPTION OF PREFERRED EMBODIMENT

Figure 2:
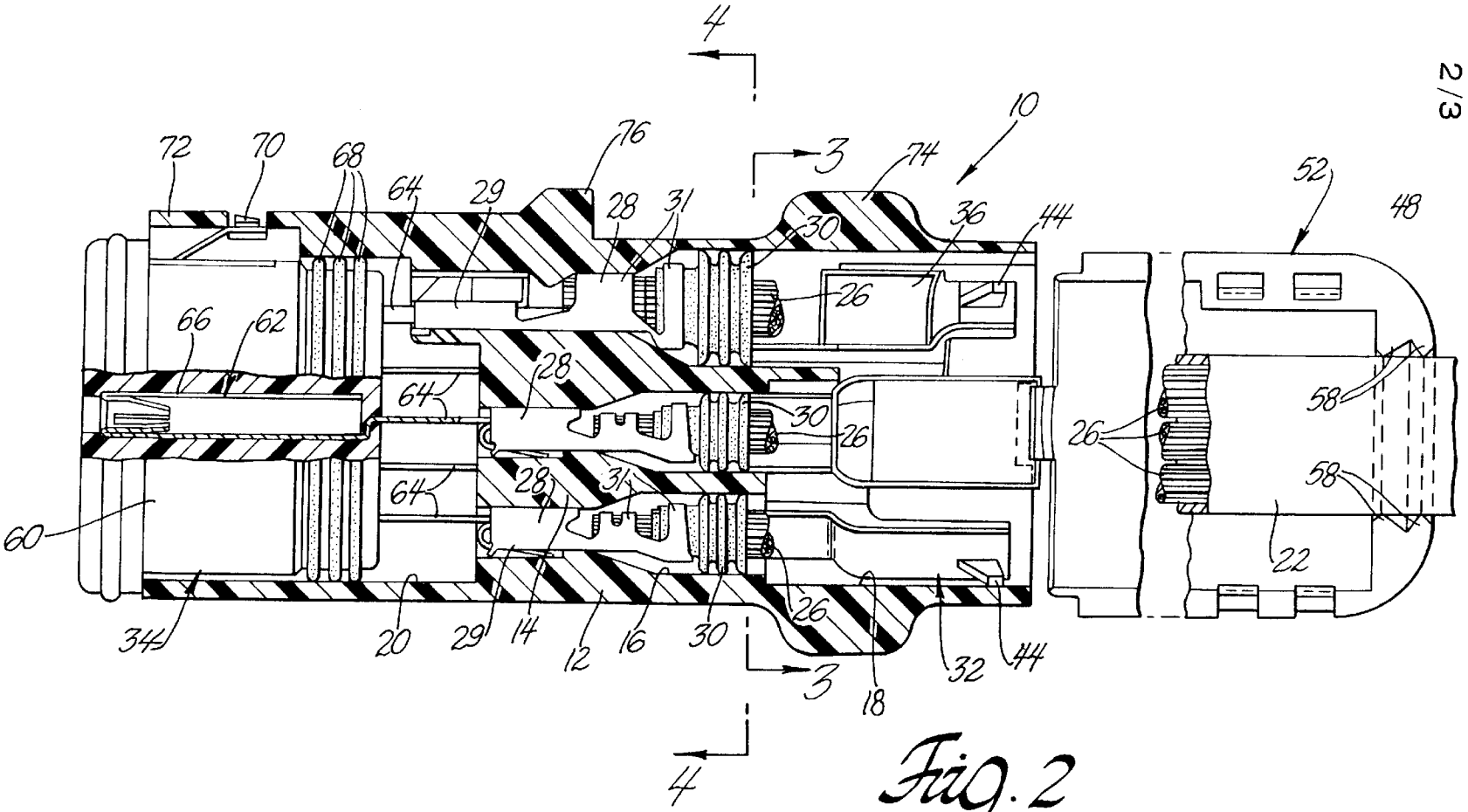
FIG. 2 is a longitudinal section of the electrical connector that is shown in FIG. 1.

Referring now to the drawing, an electrical connector assembly according to the invention is indicated generally at 10. Electrical connector assembly 10 comprises a molded plastic outer connector housing 12 that includes an integral inner connector body 14 that provides a plurality of terminal cavities 16. The typical seven conductor electrical cable connector has six circumferentially spaced terminal cavities in a circle with a seventh terminal cavity at the center. One of the circumferentially spaced terminal cavities is enlarged and offset in the axial direction. This odd cavity which is shown in the twelve o'clock position in FIG. 2 is for the power lead.

Inner connector body 14 is molded as an integral part of outer connector housing 12. Its ends are spaced from the respective ends of outer connector housing 12 so as to provide cylindrical plug-in sockets 18 and 20 at the respective opposite ends of the outer connector housing 12.

Electric cable 22 is prepared for electrical connector assembly 10 by stripping the end of outer insulation jacket 24 to separate the individual insulated leads 26. The end of the insulation jacket of each lead is then stripped away to expose a bare core end. A lead terminal 28 and an individual lead seal 30 is then attached to the end of each lead 26 in a manner that is well known to those skilled in the electrical connector art making a detailed description unnecessary for an understanding of the invention. Lead terminal 28 is a conventional type having a receptacle 29 at one end and crimp wings 31 at the other end for attaching one of the lead terminals 28 and lead seals 30 to the end of each lead 26. The power lead and the lead terminal attached to it is larger than the rest.

Each lead terminal 28 is then plugged into one of the terminal cavities 16 with the lead seal 30 engaging a wall of the terminal cavity 16 to seal the end of the terminal cavity between the wall and the lead.

Electrical connector assembly 10 also includes a terminal position assurance (TPA) device 32 and a disposable transition connector 34 that are plugged into cylindrical sockets 18 and 20 respectively. TPA device 32 comprises a separator body 36 that has a plurality of lead passages 38 extending through separator body 36 in an axial direction and radial loading passages 40 that extend from the respective lead passages 38 to the periphery of separator body 36 so that individual leads 26 can be loaded into the respective lead passages 38 after the leads 26 are terminated as described above. In this particular TPA device six (6) lead passages 38 are circumferentially spaced in an imaginary circle that has a seventh passage 38 at the center. The lead passage 38 above center lead passage 38 is enlarged for receiving the larger diameter power lead.

Separator body 36 has a round pusher portions 42 around each lead 26 at the forward end and four lock nibs 44 at the rearward end. When separator body 36 is plugged into socket 18 at the lead end of outer connector housing 12, pusher portions 42 engage axial ends of lead seals 30 pushing the lead seals 30 and lead terminals 28 forward to assure that lead terminals 28 are properly positioned in inner connector body 14. Separator body 36 is retained in socket 18 by lock nibs 44 engaging in square latch holes 46 at the cable end of outer connector housing 12. Lead seals 30 are preferably compressed slightly in the axial direction when separator body 36 is locked in place.

Figure 1:
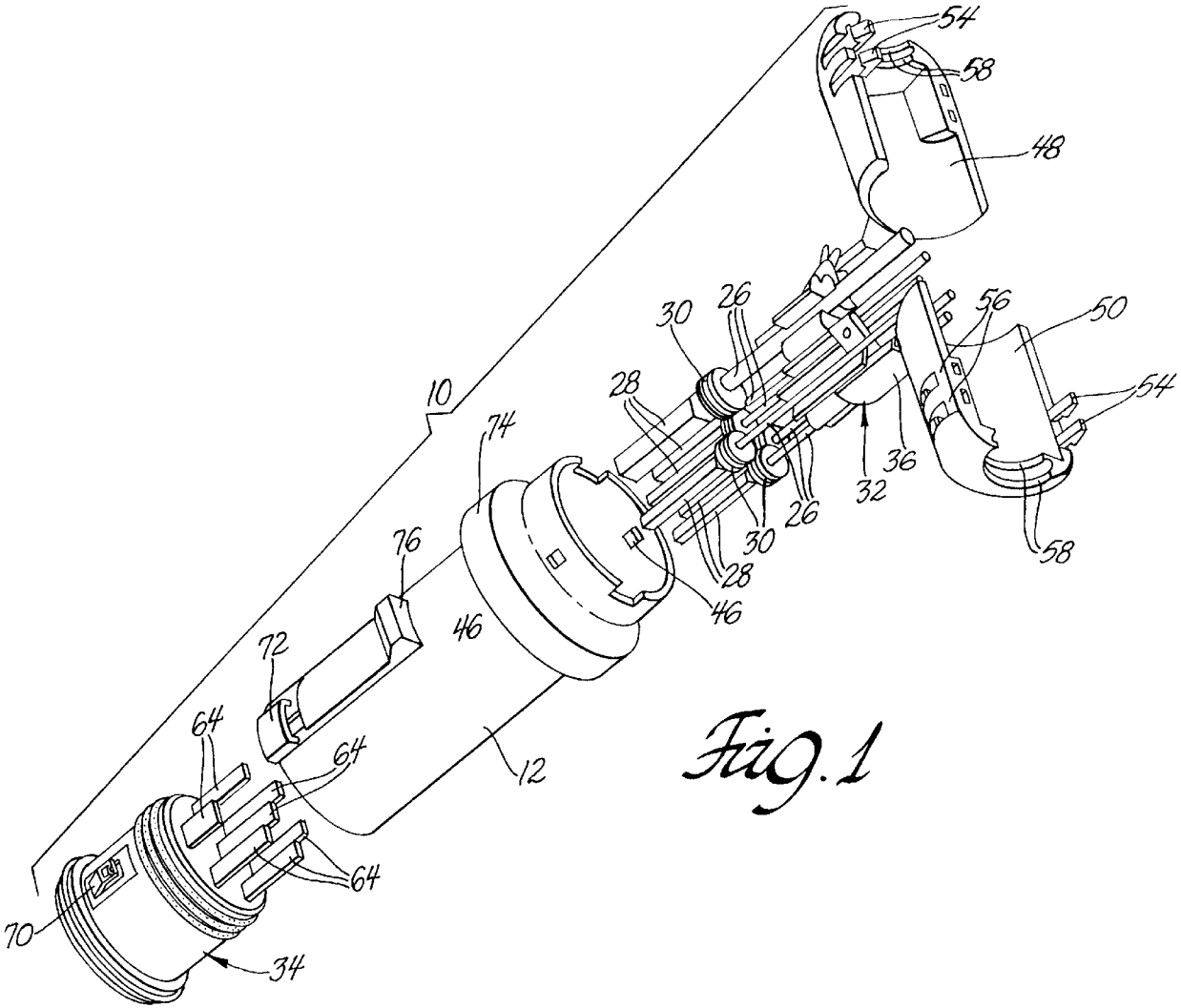
FIG. 1 is an exploded perspective view of an electrical connector assembly according to the invention.
Figure 3:
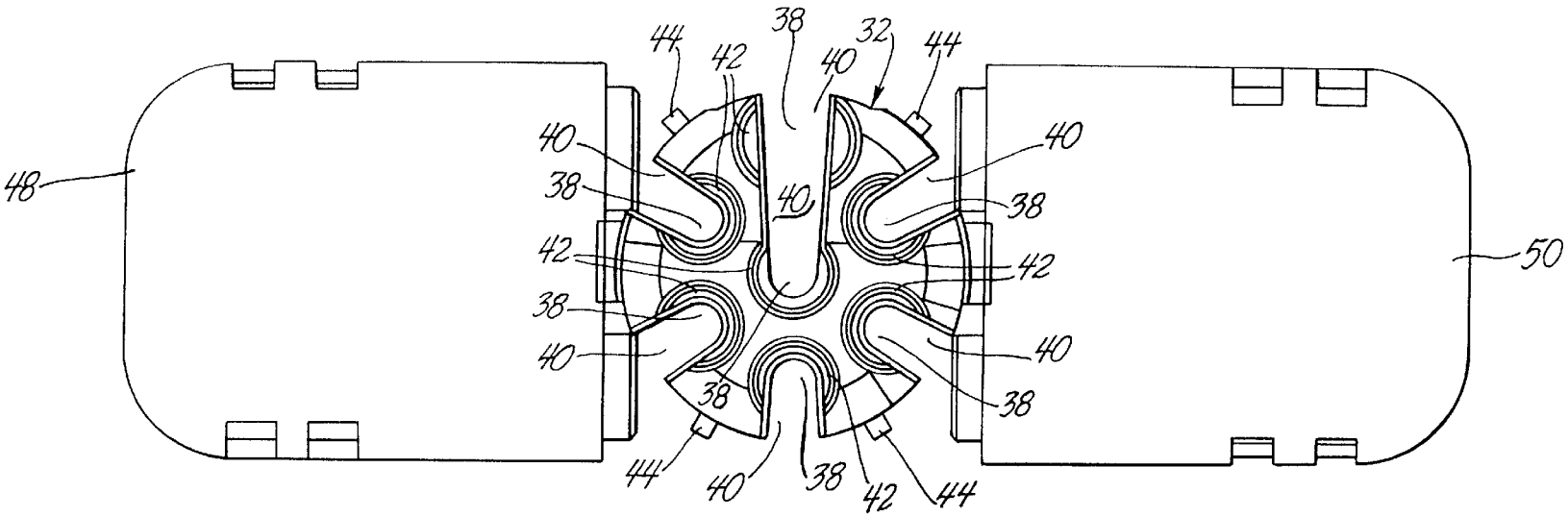
FIG. 3 is a front view of the transverse section of the electrical connector of FIG. 1 taken substantially along the line 3—3 of FIG. 2 looking in the direction of the arrows.
Figure 4:
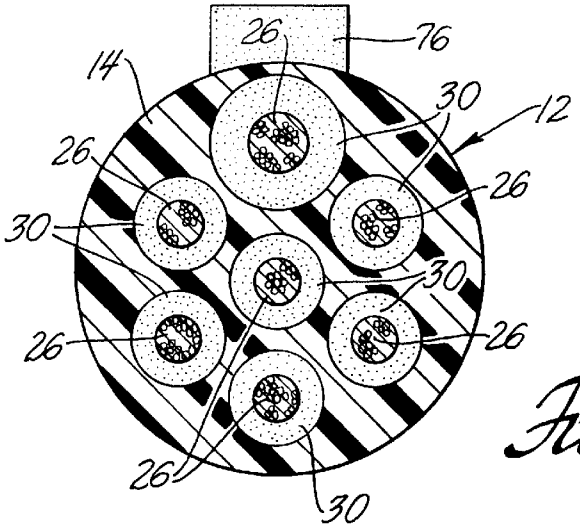
FIG. 4 is a transverse section of the electrical connector of FIG. 1 taken substantially along the line 4—4 of FIG. 2 looking in the direction of the arrows.

TPA device 32 also includes a pair of complementary clam shells 48 and 50 that are each integrally attached to the aft end of separator body 36 by a living hinge that is located between two adjacent radial loading passages 40 so that the leads 26 can be loaded radially into lead passages 38 when shell 48 and 50 are open as best shown in FIG. 3. Clam shells 48 and 50 are disposed outside outer connector housing 12 when separator body 36 is plugged into socket 18. Clam shells 48 and 50 pivot from an open position that is substantially perpendicular to the axis of separator body 36 as shown in FIGS. 1 and 3 to a closed position where the clam shells engage and form a sleeve 52 around cable 22 that is concentric with separator body 36 as shown in FIG. 2. Each shell has two latch arms 54 and two latch bars 56 near their non-hinged end that cooperate with each other to lock clam shells 48 and 50 together to form sleeve 52. Each shell also has a reduced opening with a semicircular rib 58 at the non-hinged end. Ribs 58 dig into the insulation jacket of cable 22 when shells 48 and 50 are locked together to form a strain relief for lead terminals 28 so that load is not transferred to the lead terminals 28 via leads 26 when a user pulls on the exposed part of multi-load cable 22.

The disposable transition connector 34 is plugged into the socket 20 at the connector end of the outer connector housing 12. Transition connector 34 has an elastomeric or rubber-like body 60 and a plurality of transition terminals 62 that are insert molded in elastomeric body 60. Transition terminals 62 have male contact blades 64 that protrude from the inner end of body 60 and plug into the female receptacles 29 of the lead terminals 28 housed in the inner connector body 14 that is an integral part of outer connector housing 12. Transition terminals 62 have female receptacles 66 at the opposite end that are embedded in elastomeric body 60. Elastomeric body 60 includes a plurality of axially spaced, circumferential lip seals 68 that engage the wall of socket 20 to seal the connector end of the outer connector housing 12 when transition connector 34 is plugged into socket 20. A metal retention clip 70 which is mounted on body 60 engages lock bar 72 at the connector end of connector housing 12 to hold transition connector 34 in socket 20.

Outer connector housing 12 includes an annular hand grip 74 and a thumb pad 76 to assist with plugging connector assembly 10 into a mating receptacle on a tractor or trailer (not shown) and the subsequent unplugging of the connector assembly 10.

The lead terminals 26 of electrical connector assembly 10 are completely sealed and protected from the environment by the individual lead seals 30 and the disposable transition connector 34. Moreover, the lead terminals 26 are properly positioned by TPA device 32 which also provides a strain relief to maintain the integrity of the lead terminal and lead seal connections. Thus the invention provides an electrical connector assembly that has a long life. In fact, the only metal elements that are exposed subject to a corrosive environment are the female receptacles 66 when connector assembly 10 is unplugged. Any corrosion of the female receptacles 66 is easily rectified simply by replacing the disposable transition connector 34 which is a relatively inexpensive item.

Obviously, many modifications and variations of the present invention in light of the above teachings may be made. It is, therefore, to be understood that, within the scope of the appended claims, the invention may be practiced otherwise than as specifically described.

We claim:

1. An electrical connector assembly comprising;

an outer molded connector housing having an inner connector body that includes a plurality of terminal cavities and that is molded as an integral part of the outer connector housing, the inner connector body being spaced from the respective ends of the outer connector housing so as to provide a first socket at a cable end and a second socket at a contact end of the outer connector housing, a cable having a plurality of electric leads, each lead having a lead terminal and a lead seal attached at one end, each lead terminal being plugged into one of the terminal cavities with the lead seal engaging a wall of the terminal cavity to seal the end of the terminal cavity between the wall and the lead, a terminal position assurance device having a separator body that has a plurality of lead passages extending through the body in an axial direction, each of the lead passages having a radial loading slot that extends from the passage to the periphery of the body so that individual leads of the cable can be loaded into the respective lead passages, the separator body being plugged into the first socket at the cable end of the outer connector housing and having forward pusher portions engaging axial ends of the lead seals to properly position the lead terminals in the inner connector body, the terminal position assurance device having a pair of clam shells that are disposed outside the outer connector housing and that are individually attached to a rearward end of the separator body by a living hinge, the clam shells being pivotal from an open position allowing the loading of the leads of tube cable into the cable passages to a closed position encompassing the leads and embracing the cable, the clam shells each having an arcuate rib that engages the cable to provide a strain relief when the clam shells are in the closed position, means for locking the clam shells in the closed position, and a disposable transition connector plugged into the second socket at the connector end of the outer connector housing, the transition connector having an elastomeric body and a plurality of transition terminals that are insert molded in the elastomeric body, the transition terminals having a male contact at one end and a female receptacle at the opposite end, and the elastomeric body having a circumferential lip seal engaging a wall of the second socket to seal the contact end of the outer connector housing.

2. An electrical connector as defined in claim 1 wherein the disposable transition connector has an exposed outer end and wherein the transition terminals have the female receptacle adjacent the exposed outer end.

3. An electrical connector assembly comprising;

an outer connector housing having a plurality of terminal cavities, the terminal cavities being molded as an integral part of the outer connector housing and being spaced from the respective ends of the outer connector housing so as to provide a plug-in socket at each end of the outer connector housing, a cable having a plurality of electric leads each lead having a lead terminal and a lead seal attached at one end that is disposed in one of the terminal cavities with the lead seal engaging a wall of the terminal cavity to seal the end of the terminal cavity between the wall and the lead, a terminal position assurance device having a separator body that separates the plurality of electrical leads from each other disposed in the plug-in socket at one end of the outer connector housing, with forward portions of the separator body engaging axial ends of the lead seals to properly position the lead terminals in the terminal cavities, the terminal position assurance device having a pair of clam shells that are disposed outside the outer connector housing and that are individually attached to a rearward end of the separator body by a living hinge, the clam shells being pivotal from an open position to a closed position engaging the cable to provide a strain relief, and a disposable transition connector disposed in the plug-in socket at an opposite end of the outer connector housing, the transition connector having an elastomeric body and a plurality of terminals insert molded in the elastomeric body, and the elastomeric body having a circumferential lip seal engaging the wall of the last mentioned plug-in socket to seal the opposite end of the outer connector housing.

4. An electrical connector as defined in claim 3 wherein the plurality of terminals insert molded in the elastomeric body of the transition connector each have a male contact at one end and a female receptacle at the opposite end.

5. An electrical connector assembly comprising;

an outer connector housing having a plurality of terminal cavities, the terminal cavities being molded as an integral part of the outer connector housing and being spaced from the respective ends of the outer connector housing so as to provide a socket at each end of the outer connector housing, a cable having a plurality of electric leads each lead having a lead terminal and a lead seal attached at one end that is disposed in one of the terminal cavities with the lead seal engaging a wall of the terminal cavity to seal the end of the terminal cavity between the wall and the lead, a terminal position assurance device having a separator body that separates the plurality of electrical leads from each other disposed in the socket at one end of the outer connector housing, the terminal position assurance device having forward portions of the separator body engaging axial ends of the lead seals to properly position the lead terminals in the terminal cavities, a disposable transition connector disposed in the socket at an opposite connector end of the outer connector housing, the transition connector having an elastomeric body and a plurality of terminals insert molded in the elastomeric body, and the elastomeric body having a circumferential lip seal engaging the wall of the last mentioned socket to seal the opposite end of the outer connector housing.

6. An electrical connector as defined in claim 5 wherein the plurality of terminals insert molded in the elastomeric body of the transition connector each have a male contact at one end and a female receptacle at the opposite end.

* * * * *